US008315541B2

(12) United States Patent
Kinokuni

(10) Patent No.: US 8,315,541 B2
(45) Date of Patent: Nov. 20, 2012

(54) IMAGE FORMING APPARATUS USING CLEANER-LESS SYSTEM

(75) Inventor: Jiro Kinokuni, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 304 days.

(21) Appl. No.: 12/619,824

(22) Filed: Nov. 17, 2009

(65) Prior Publication Data

US 2010/0124436 A1 May 20, 2010

(30) Foreign Application Priority Data

Nov. 19, 2008 (JP) ..... 2008-296134
Nov. 4, 2009 (JP) ..... 2009-253073

(51) Int. Cl.
*G03G 21/00* (2006.01)

(52) U.S. Cl. ..... 399/129

(58) Field of Classification Search ..... 399/99, 399/149, 150, 354, 129
See application file for complete search history.

(56) References Cited

U.S. PATENT DOCUMENTS 5,555,079 A * 9/1996 Adachi et al. ..... 399/175
6,922,539 B2 * 7/2005 Uyama et al. ..... 399/129

FOREIGN PATENT DOCUMENTS

JP 10-207186 A 8/1998
JP 2001-215799 A 8/2001
JP 3507265 B2 3/2004

OTHER PUBLICATIONS

Machine Translation of JP 10-207186 A obtained on Dec. 14, 2011.*
Notification of First Office Action issued Oct. 9, 2011, in Chinese Application No. 200910223515.7.

* cited by examiner

*Primary Examiner* — David Gray
*Assistant Examiner* — Gregory H Curran
(74) *Attorney, Agent, or Firm* — Fitzpatrick, Cella, Harper & Scinto

(57) ABSTRACT

An image forming apparatus includes a rotatable photosensitive member; a charging device for electrically charging the photosensitive member; a developing device for developing with toner an electrostatic latent image formed on the photosensitive member electrically charged by the charging device; a transfer device for transferring a toner image from the photosensitive member onto an image-receiving member; and an auxiliary charging device for electrically charging untransferred toner on the photosensitive member to a normal charge polarity before the photosensitive member is electrically charged by the charging device; wherein effective widths $W_{PM}$, $W_{CD}$, $W_{DD}$, $W_{TD}$, and $W_{ACD}$ of the photosensitive member, the charging device, the developing device, the transfer device, and the auxiliary charging device satisfy:

$$W_{PM}>W_{CD}>W_{ACD}\geqq W_{TD}>W_{DD}.$$

4 Claims, 7 Drawing Sheets

(a)

(b)

(a)

(b)

IMAGE FORMING APPARATUS USING CLEANER-LESS SYSTEM

FIELD OF THE INVENTION AND RELATED ART

The present invention relates to an image forming apparatus using a cleaner-less system for developing an electrostatic latent image on a photosensitive member and collecting untransferred toner on the photosensitive member at the same time by a developing device.

With respect to an electrophotographic apparatus (image forming apparatus), the cleaner-less system in which the untransferred toner on the photosensitive member is collected in the developing device and is reused has been known. Specifically, the developing device collects the untransferred toner deposited on the photosensitive member simultaneously with the development of the electrostatic latent image formed on the photosensitive member. As a result, the untransferred toner on the photosensitive member is removed by the developing device. An advantage of the cleaner-less system is that there is no need to dispose of residual toner. For this reason, a maintenance property of the image forming apparatus is improved and it is possible to downsize the image forming apparatus by a space of a container containing the residual toner.

In such a cleaner-less system, in order to efficiently collect the untransferred toner on the photosensitive member, an auxiliary charger for effecting control of electric charge to be applied to the untransferred toner has been used. Further, in order to improve a collection rate of the untransferred toner, a reciprocating mechanism such that it is reciprocally moved in the longitudinal direction of the photosensitive member in order that a distribution of the untransferred toner deposited on the photosensitive member can be uniformized has been employed.

Specifically, FIG. 2(*a*) is a schematic view for illustrating a length relationship among respective constitutional elements associated with image formation using a conventional cleaner-less system (Conventional Embodiment 1). In a process cartridge shown in FIG. 2(*a*), an abrasion amount of the photosensitive member in area (2) was larger than those in other areas (FIG. 2(*b*)).

The reasons therefor are as follows. When the image formation is effected, the toner is scattered from an end portion of a sleeve for carrying the toner. The scattered toner is deposited on the photosensitive member in areas (1), (2) and (3). The scattered toner deposited on the photosensitive member in the area (3) is charge-adjusted by the auxiliary charger and then is transferred onto an intermediary transfer member or the like by a transfer charger, so that the scattered toner is not readily accumulated (deposited). However, the untransferred toner deposited on the photosensitive member in the areas (1) and (2) is not charge-adjusted by the auxiliary charger, thus being gradually accumulated (deposited) (scattered toner accumulation area). Here, when the scattered toner contacts the charger in the scattered toner accumulation area, abnormal electric discharge occurs. For this reason, in the area (2) of the photosensitive member, the abrasion amount of the photosensitive member is increased. Incidentally, when the photosensitive member is abraded to decrease a thickness of its surface layer, photosensitive member leak occurs. Further, when an electroconductive layer of the photosensitive member is exposed at even a part of the photosensitive member surface, a current from a charging roller concentrates at the exposed portion (i.e., the leak occurs), so that the image formation cannot be effected. That is, if the abrasion amount in any of the areas (1), (2) and (3) exceeds a predetermined abrasion amount (e.g., an abrasion unacceptable line of 12 μm), a drum cartridge reaches the end of its lifetime. Specifically, in a conventional constitution, in the area (2), the photosensitive member is abraded to the extent its surface reaches the electroconductive layer when the image formation is continued on about 30,000 sheets.

A constitution for increasing the lifetime of the drum cartridge by suppressing the abrasion in the case (2) in which the scattered toner is deposited has been disclosed in Japanese Laid-Open Patent Application (JP-A) 2001-215799 (Conventional Embodiment 2). Respective constituent elements associated with the image formation disclosed in JP-A 2001-215799 satisfy a (length) relationship as shown in FIG. 3(*a*). Specifically, a width of the auxiliary charger is made equal to that of the transfer charger, so that the electric charge of the scattered toner deposited in the areas (2) and (3) is controlled. Further, the charge-controlled scattered toner is transferred onto an intermediary transfer belt 16 by the transfer charger. As a result, it is possible to suppress the abnormal electric discharge caused due to the deposition of the scattered toner (FIG. 3(*b*)).

However, when the constitution disclosed in JP-A 2001-215799 is employed, a width ($W_{CTG}$) of the drum cartridge is excessively increased in the case where the same image forming area ($W_M$: e.g., A4 size or the like) is intended to be ensured. That is, the auxiliary charger which is reciprocally moved is increased in length (width), so that the width of the drum cartridge is wider than that in the above-described conventional constitution (Conventional Embodiment 1).

Therefore, it has been desired to provide a compact image forming apparatus with less frequency of exchange of the drum cartridge by downsizing the drum cartridge while decreasing the number of the exchange of the drum cartridge by the increase in lifetime of the photosensitive member.

SUMMARY OF THE INVENTION

A principal object of the present invention is to provide an image forming apparatus which is reduced in size while decreasing exchange frequency of a drum cartridge.

According to an aspect of the present invention, there is provided an image forming apparatus comprising:

a rotatable photosensitive member;

a charging device for electrically charging the photosensitive member;

a developing device for developing with toner an electrostatic latent image formed on the photosensitive member electrically charged by the charging device;

a transfer device for transferring a toner image from the photosensitive member onto an image-receiving member; and an auxiliary charging device for electrically charging untransferred toner on the photosensitive member to a normal charge polarity before the photosensitive member is electrically charged by the charging device;

wherein effective widths $W_{PM}$, $W_{CD}$, $W_{DD}$, $W_{TD}$, and $W_{ACD}$ of the photosensitive member, the charging device, the developing device, the transfer device, and the auxiliary charging device satisfy:

$$W_{PM} > W_{CD} > W_{ACD} \geqq W_{TD} > W_{DD}.$$

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS (Embodiment 1)

Hereinbelow, the image forming apparatus according to the present invention will be described specifically with reference to the drawings. First, a constitution of the image forming apparatus and respective materials and effective widths of respective constitutional elements of the image forming apparatus will be described (<1> to <3>). Next, an image forming process in a cleaner-less system will be described (<4> to <6>). Then, the constitution in this embodiment will be described in comparison with conventional constitutions (<6> to <9>).

<1> General Structure of Image Forming Apparatus

Figure 1:
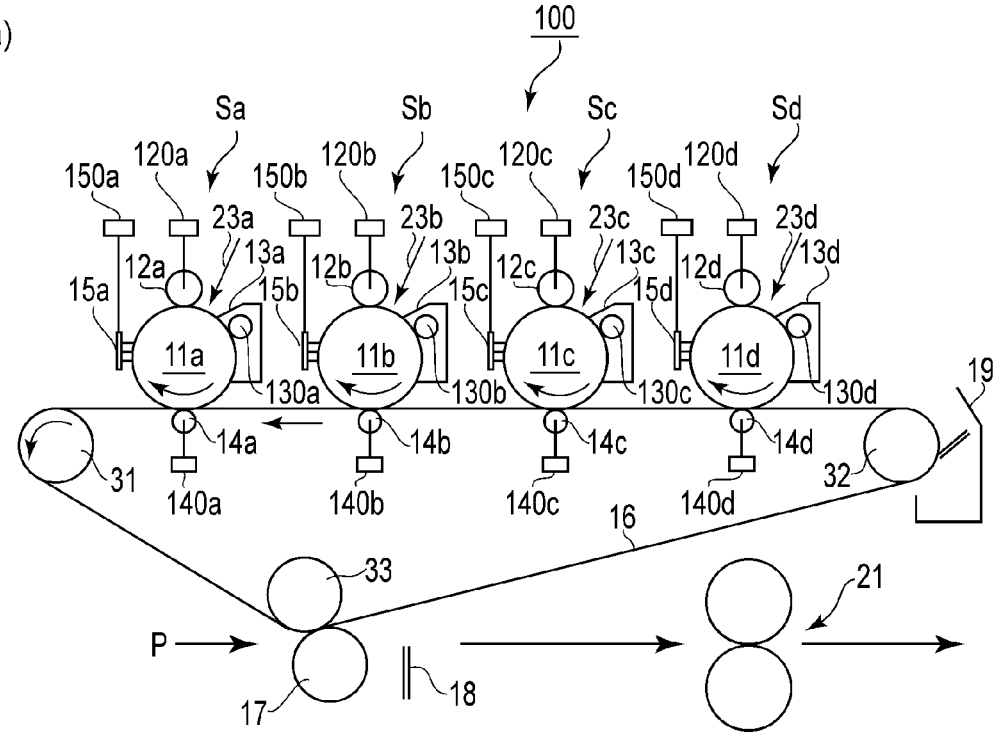
FIGS. 1(*a*) and 1(*b*) are schematic structural views showing an embodiment of the image forming apparatus according to the present invention.
Figure 1:
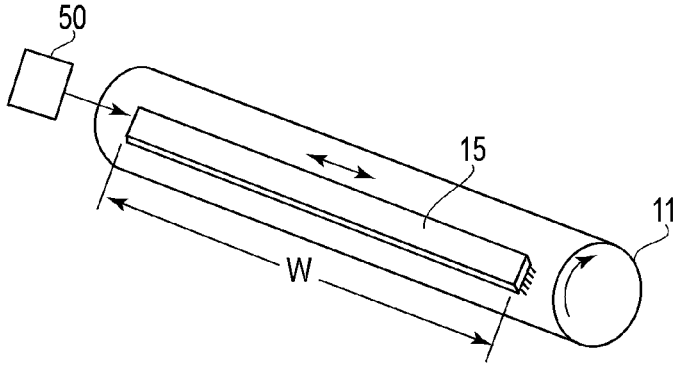

FIG. 1(*a*) is a schematic structural view showing an image forming apparatus 100 in this embodiment according to the present invention. The image forming apparatus 100 in this embodiment is a tandem type full-color image forming apparatus in which four image forming portions are disposed side by side along a rotational direction of an intermediary transfer member. Incidentally, the scope of the present invention is not limited unless otherwise specified. The respective image forming portions S (Sa, Sb, Sc, Sd) form toner images of yellow, magenta, cyan, and black, respectively. The constitutions of these image forming portions are substantially identical to each other, so that the constitution of the image forming portion Sa will be specifically described. The image forming portion Sa includes a drum-like electrophotographic photosensitive member 11*a* as an image bearing member (hereinafter referred to as a photosensitive drum). Around the photosensitive drum 11*a*, constitutional elements associated with image formation are disposed and supported integrally with the photosensitive drum 11*a* as a cartridge. In this way, the cartridge including electrophotographic process means integrally supported with the photosensitive drum ll*a* is referred to as a drum cartridge (process cartridge). The drum cartridge is detachably mounted to a main assembly of the image forming apparatus by a mounting means (not shown). The photosensitive drum 11*a* has a structure in which a photosensitive layer is formed on a hollow cylindrical electroconductive support.

Around the photosensitive drum 11*a*, along the rotational direction of the photosensitive member 11*a*, a charging roller 12*a* as a charger and a developing device 13*a* (including a developing sleeve 130*a*) are disposed. Further, downstream of the developing device 13*a* with respect to the drum rotational direction, a primary transfer roller 14*a* as a primary transfer charger and an auxiliary charging brush (auxiliary charger) 15*a* as an auxiliary charging device are disposed along the rotational direction of the photosensitive drum. The auxiliary charging brush 15 is provided so as to be reciprocally moved in the rotational shaft (axis) direction of the photosensitive drum by a reciprocating drive mechanism (gear train) (FIG. 1(*b*)). In this embodiment, the drum cartridge consists of the photosensitive drum 11, the charging roller 12, the developing device 13, and the auxiliary charger 15. Incidentally, a member having a lifetime longer than that of the photosensitive drum may also be provided to the main assembly of the image forming apparatus. For example, in the case where the lifetime of the developing device 13 is sufficiently longer than that of the photosensitive drum, the developing device 13 may also be disposed separately from the drum cartridge. Obliquely above the photosensitive drum 11, a laser exposure device 23 as an exposure means is disposed and is configured to perform image exposure, i.e., to irradiate the surface of the photosensitive drum 11 with a laser beam modulated based on image information. An electrostatic latent image thus formed on the photosensitive drum is developed with the toner, so that the toner image is carried on the photosensitive drum as the image bearing member. The image forming portions includes the charging devices 12*a* to 12*d*, the exposure means 23*a* to 23*d*, the developing devices 13*a* to 13*d*, the primary transfer devices 14*a* to 14*d*, and the auxiliary chargers 15*a* to 15*d*. Further, the respective developing devices 13*a* to 13*d* include sleeves 130*a* to 130*d* as the developer carrying member for carrying the developer containing the toner.

Between the photosensitive drums (11*a*, 11*b*, 11*c*, 11*d*) and the primary transfer chargers (14*a*, 14*b*, 14*c*, 14*d*), an intermediary transfer belt 16 as the intermediary transfer member is disposed. The intermediary transfer belt 16 is stretched around rollers 31, 32 and 33 and is movable in a direction indicated by an arrow. The respective color toner images formed on associated photosensitive drums are transferred onto the intermediary transfer belt. Further, a secondary transfer roller 17 constituting a secondary transfer charger is disposed oppositely to an opposite roller 33 to form a secondary transfer portion. A paper (sheet) separating means 18 is disposed adjacently to the secondary transfer roller 17. Further, an intermediary transfer belt cleaning means 19 as a cleaning means is disposed oppositely to the roller 32 for stretching the intermediary transfer belt 16. Further, at a lower portion of the image forming apparatus, a sheet feeding device is disposed for feeding a recording material P toward the secondary transfer charger 17. Further, on a downstream side of the separating device 18 with respect to a conveying direction of the recording material P separated by the separating device 18, a fixing device 21 and a sheet discharge tray (not shown) are disposed.

<2> Material and Effective Width of Each Constituent Element

Hereinbelow, the photosensitive drum, the charging device, the developing device, the transfer device, the auxiliary charging device and the intermediary transfer belt which are associated with the respective image forming steps will be specifically described. Incidentally, the respective materials in Conventional Embodiment 1 and Conventional Embodiment 2 are identical to those in this embodiment for comparison purposes.

(Material and Effective Width of Photosensitive Drum)

Figure 2:
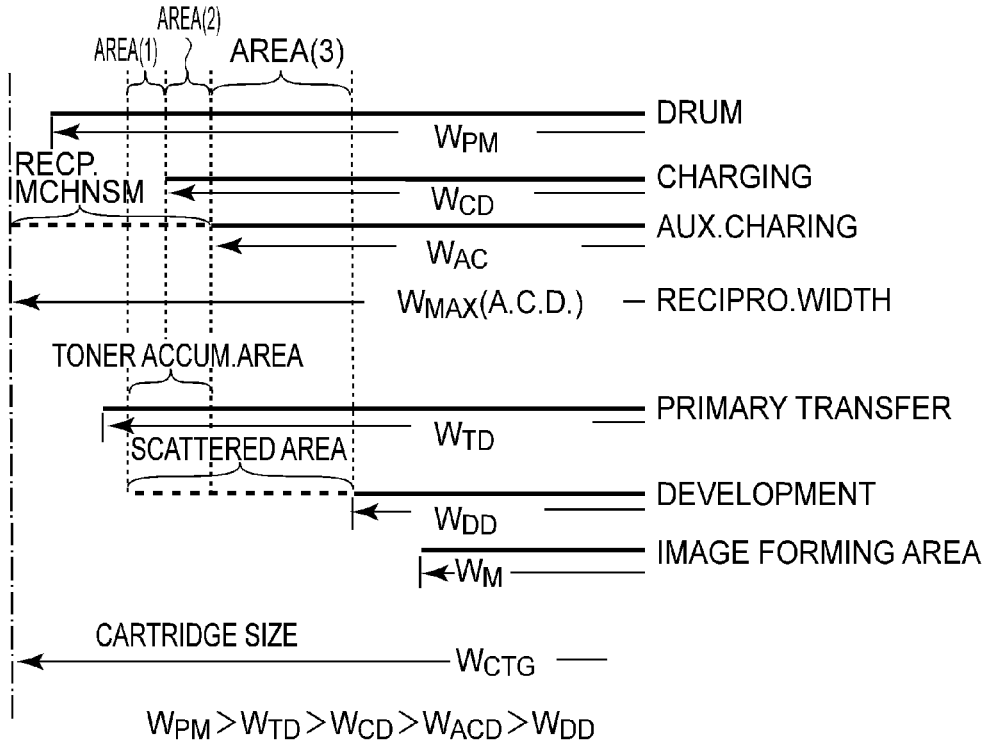
FIGS. 2(*a*) and 2(*b*) are schematic views for illustrating lengths (widths) of respective image forming elements in their longitudinal directions in a conventional constitution in which an auxiliary charger is shorter and for illustrating a photosensitive drum abrasion amount in the constitution, respectively (Conventional Embodiment 1).
Figure 2:
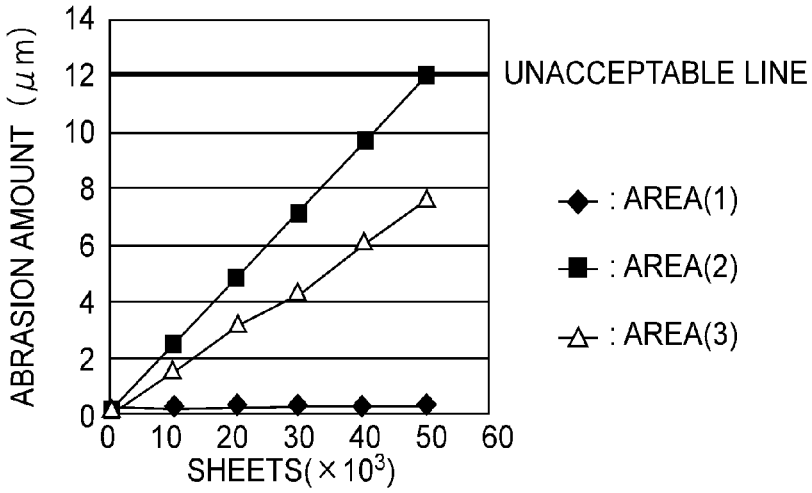

In this embodiment, the photosensitive drum 11 as the image bearing member (photosensitive member) was prepared by applying an organic photosensitive material for an organic photoconductor (OPC) onto an outer peripheral surface of an aluminum cylinder. The photoconductor may also be α-Si, CdS, Se or the like. Incidentally, when the surface layer of the photosensitive drum is abrased in about 10 μm by the electric discharge or abrasion, the photosensitive member leak occurs. Here, the width of the photosensitive drum with respect to the longitudinal direction of the photosensitive layer is referred to as an effective width and is represented by $W_{PM}$ as shown in FIG. 2(*a*), FIG. 3(*a*) and FIG. 5(*a*).

(Material and Effective Width of Charging Roller)

In this embodiment, the charging roller 12 as the charging device has a single rubber layer structure formed of epichlorohydrin. The single rubber layer has a volume resistivity of $10^5$ to $10^6$ ohm.cm. As the material for constituting the charging roller 12, ion or electron conductive materials such as EPDM and NBR and other materials including rayon, nylon-based materials, and fluorine-containing materials may also be used. The charging roller may be a sponge roller or a brush roller. The charging roller may have a resistance value (initial resistance in a normal temperature/normal humidity environment) of $1.0\times10^5$ to $1.0\times10^7$ ohm. Here, the length (width) of the rubber layer of the charging roller is referred to as an effective width and is represented by $W_{CD}$. In other words, $W_{CD}$ represents a width of an area in which the charging roller 12 contacts the photosensitive drum 11.

(Material and Effective Width of Developing Device)

In this embodiment, as the developing roller 130 of the developing device 13, a hollow aluminum roller was used. Inside the developing roller 130, a magnet is disposed. The charge amount of the toner in each of the developing devices is adjusted in the range of −25 to 35 μC/mg and in order that flowability of the toner is not excessively increased, the content of oil-treated silica of 20 nm in diameter is 30% or less. Here, a width of the magnet inside the developing roller is referred to as a developing effective width and is represented by $W_{DD}$. In other words. $W_{DD}$ represents a coating width of the developer (toner) to be coated on the developing roller by the magnet.

(Material and Effective Width of Transfer Roller)

In this embodiment, as a material for the primary transfer roller 14, a sponge foam having a 4 mm-thick single layer structure of NBR was used. The sponge foam has a volume resistivity of $10^5$ to $10^6$ ohm.cm. Here, a length (width) of the sponge layer of the transfer roller is referred to as a transfer effective width and is represented by $W_{TD}$. In other words, $W_{TD}$ represents a width of an area in which the sponge layer of the transfer roller contacts the intermediary transfer belt 16 (a width of the primary transfer nip).

(Material and Effective Width of Auxiliary Charger)

In this embodiment, as the auxiliary charger 15, a fixed brush including a metal plate and fibers implanted into the metal plate was used. The fibers are electroconductive rayon fibers having a fineness of 6 denier, a pile length of 5 mm, and a fiber (filament) density of 100 KF. As other fibers, nylon fibers and polyester fibers may also be used. These fibers may desirably have the fineness of 2 to 10 denier, the pile length of 3 to 8 mm, and the fiber density of 50 to 500 KV. Here, a width of an area in which the fibers for the auxiliary charger are implanted is referred to as an auxiliary charging effective width and is represented by $W_{ACD}$. In other words, $W_{ACD}$ represents a width of an area in which the fiber-implanted brush contacts the photosensitive drum 11.

(Material and Effective Width of Intermediary Transfer Belt)

In this embodiment, as the intermediary transfer belt 16, a 5 μm-thick belt formed of polyimide (PI) resin was used. The polyimide resin belt has a surface resistivity of $10^{11}$ to $10^{13}$ ohm.cm$^2$ and a volume resistivity of $10^9$ to $10^{10}$ ohm.cm. As the material for the intermediary transfer belt, it is also possible to use PVDF, PET, PBT, EPDM, NBR, urethane rubber, silicone rubber, etc. Here, a length (width) from one (lateral) end to the other (lateral) end of the intermediary transfer belt is referred to as a transfer belt effective width and is represented by $W_{ITB}$.

<3> Reciprocally Moving Mechanism for Auxiliary Charging Brush

In the case where an image with a high image ratio is continuously formed in a part of an area with respect to the longitudinal direction of the photosensitive drum, the untransferred toner having passed through the auxiliary charger 15 is accumulated on the charging roller 12. In the case where an accumulation amount of the untransferred toner on the charging roller exceeds a certain amount, the charging roller 12 cannot electrically charge the photosensitive drum 11 to a predetermined potential stably. Especially, when the untransferred toner is locally accumulated on the charging roller 12 cannot electrically charge the photosensitive drum uniformly. For that reason, image defect due to charging non-uniformity is caused to occur.

Further, in the case where a contact transfer method in which the photosensitive drum and the intermediary transfer belt are brought into contact with each other and the toner image formed on the photosensitive member is transferred onto the intermediary transfer belt is employed, a mechanical depositing force of the untransferred toner deposited on the photosensitive drum 11 is large due to an urging force during the transfer. Particularly, in the case where a line image of a plurality of colors of toners superposed on the intermediary transfer belt is deposited on the photosensitive drum, the amount of the untransferred toner on the photosensitive drum is large and the mechanical depositing force of the untransferred toner on the photosensitive drum is also large. For that reason, it is difficult to collect the untransferred toner on the photosensitive member (photosensitive drum) by an electrical and mechanical collecting force of the developing device 13. The untransferred toner on the photosensitive member which has not been collected by the developing device causes the image defect such that the untransferred toner contacts the intermediary transfer belt again and is formed on the sheet as an image.

For that reason, in the cleaner-less system, a reciprocating mechanism 50 is employed so that the untransferred toner on the photosensitive drum is mechanically distributed with respect to the rotation shaft (axis) direction of the photosensitive drum. In this embodiment, as the reciprocating mechanism 50, a well-known cam slider is used and is reciprocated (reciprocally moved) along the longitudinal direction of the elongated auxiliary charger 15. By this reciprocating mechanism 50, the untransferred toner deposited on the charging roller 12 is prevented from being deposited at only a certain portion of the charging roller 12, thereby to attenuate the degree of the charging non-uniformity. Further, the mechanical depositing force of the untransferred toner is alleviated by a rubbing force of the auxiliary charger 15, so that the collecting rate at the developing device can be improved. However, the reciprocating mechanism 50 which reciprocally moves the auxiliary charger 15 has constituted a major obstacle to downsizing of the drum cartridge. Specifically, as is clear from FIGS. 2(*a*) and 3(*a*), a cartridge size ($W_{CTG}$) largely varies depending on a distance of the reciprocal movement of the auxiliary charging brush.

(Effective Width of Reciprocally Moving Mechanism and Auxiliary Charging Brush)

As described above, $W_{ACD}$ is the implanted-fiber width of the brush. However, when the auxiliary charging brush is reciprocated, a width affected by the auxiliary charging brush is substantially extended. Therefore, a width in which the auxiliary charging brush is movable is referred to as a maximum effective width and is represented by $W_{MAX}$ (or $W_{RM}$ (reciprocating mechanism)).

<4> Collecting Rate of Untransferred Toner

Figure 4:
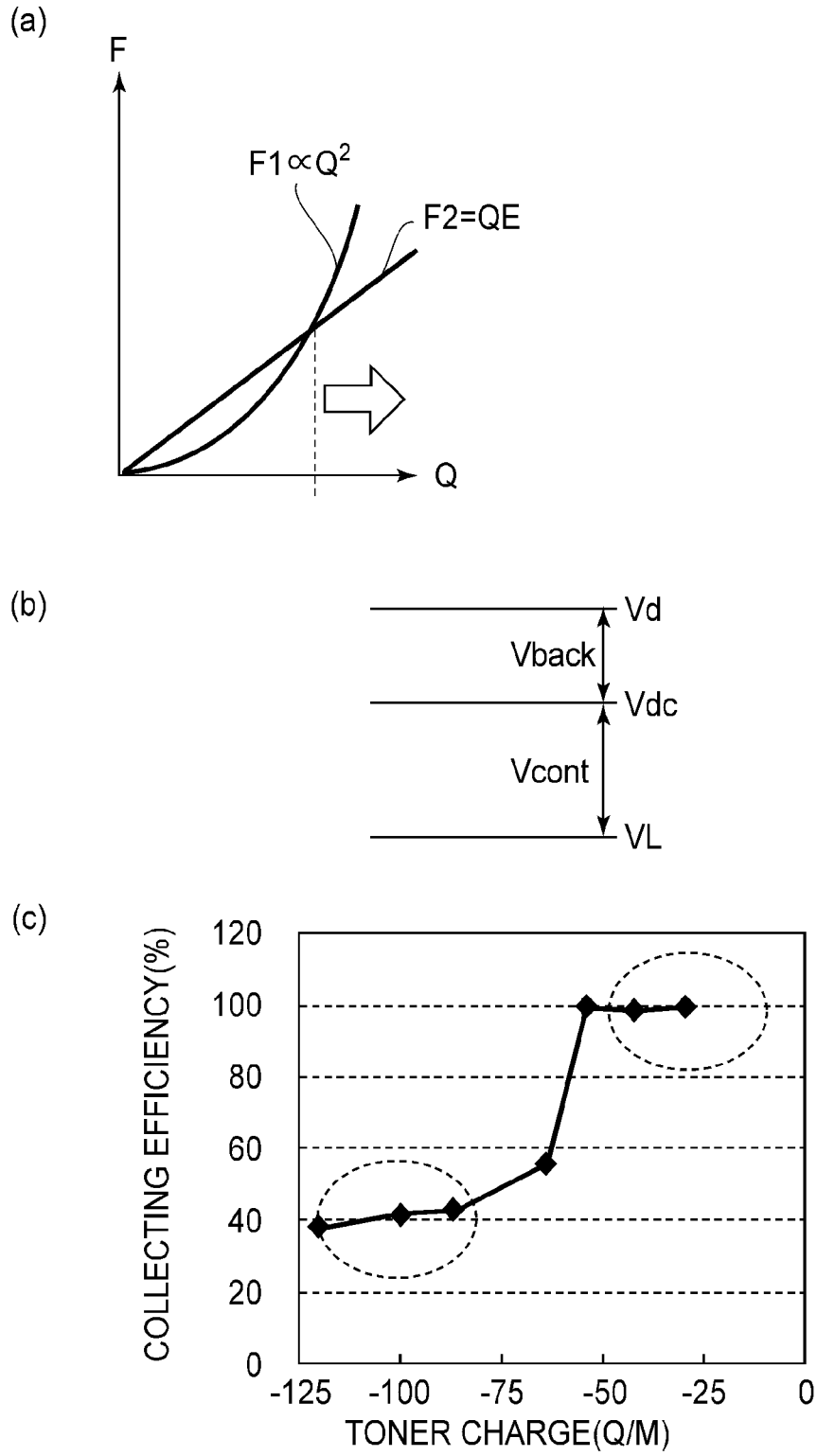
FIGS. 4(*a*), 4(*b*) and 4(*c*) are schematic views for illustrating collection of toner in a cleaner-less system.

Hereinbelow, the collection of the untransferred toner in the cleaner-less system will be described. FIG. 4(*a*) is a graph showing a relationship between the electric charge Q of the toner and a force F exerted on the toner. FIG. 4(*b*) is a schematic view for illustrating an electric field formed at the developing portion. In FIG. 4(*b*), Vd and VL represent a dark portion potential and a light portion potential, respectively, of the photosensitive drum 11 and Vdc represents a developing bias voltage. Further, Vback represents a fog-removing bias potential difference and Vcont represents a potential difference showing a density. FIG. 4(*c*) is a graph including experiment-based data and showing an efficiency of collection of the untransferred toner by the developing device 13 when the electric charge of the toner having reached the developing device 13 is changed by settings for the charging roller 12 and the auxiliary charger 15.

In a range of (mirror force)<(developing device collection force) in FIG. 4(*a*), a developing device collection efficiency is about 100% (FIG. 4(*c*)), thus being high. On the other hand, in a range of (mirror force)>(developing device collection force) in FIG. 4(*a*), the developing device collection efficiency is about 40% (FIG. 4(*c*)), thus being low. For that reason, in the cleaner-less system, it is desirable that the electric charge of the untransferred toner is adjusted so as to satisfy: (mirror force)<(developing device collection force) for the purpose of efficiently collecting the untransferred toner by the developing device. Here, in FIG. 4(*a*), F1 represents the mirror force and satisfies $F1 \propto Q^2$ (Q: electric charge of toner on photosensitive drum), and F2 represents the developing device collection force and satisfies F2 =QE (E =V/d where V is Vback and d represents a distance between the photosensitive drum and the developing roller).

<5> Image Forming Process

An image forming mode in the above-described image forming apparatus will be briefly described. The image forming apparatus includes a power source (high voltage source) and a controller (not shown) as a control means for controlling the respective portions. When the power source is turned on, by a main motor (not shown), the photosensitive drum 11 and the charging roller 12 start their rotations at their predetermined rotational speeds. When execution of an image forming operation is instructed, a DC voltage biased with an AC voltage is applied as a bias voltage from the high voltage source 120 (120*a*, 120*b*, 120*c*, 120*d*) as a bias application means to the charging roller 12. As a result, the surface of the photosensitive drum 11 (11*a* to 11*d*) is electrically charged to a predetermined potential. The charging bias applied to the charging roller in this embodiment is in the form of a DC bias (−700 V) biased (superposed) with an AC bias (1800 Vpp). By the image exposure from the laser exposure from the laser exposure device 23, i.e., by the irradiation of the surface of the photosensitive drum 11 with the laser beam modulated based on the image information, the electrostatic latent image (imagewise latent image) is formed on the surface of the photosensitive drum 11. The thus formed imagewise latent image reaches a position of the developing device 13 by the rotation of the photosensitive drum 11. The latent image is visualized by the developer (toner) conveyed by the developing roller 130 (130*a*, 130*b*, 130*c*, 130*d*) as the developer carrying member of the developing device 13 in which the developer (toner) is contained. A developing bias applied to the developing device 13 in this embodiment is in the form of the DC bias (−550 V) biased with the AC bias (1500 Vpp). The distance d between the photosensitive drum 11 and the developing roller 130 (so-called S-D gap) is 400 μm.

Then, a bias of an opposite polarity to the toner charge polarity is applied from a high voltage source 140 (140*a*, 140*b*, 140*c*, 140*d*) as the bias application means to the primary transfer charger 14. As a result, the toner image formed on the photosensitive drum 11 by the development is transferred onto the intermediary transfer belt 16.

Thus, the toner images formed on the respective photosensitive drums (11*a* to 11*d*) are successively transferred onto the intermediary transfer belt 16. The recording material P is sent from the sheet feeding device 20 with timing at which the toner images transferred onto the intermediary transfer belt 16 reach a portion (secondary transfer portion) at which the toner images are to be transferred by the secondary transfer charger. As a result, the toner images superposed on the intermediary transfer belt are transferred onto the sheet-like recording material P by the transfer roller 17 as the secondary transfer charger. The recording material P on which the toner images are transferred is separated from the intermediary transfer belt 16 by the separating device 18 and thereafter is subjected to a fixing process in the fixing device 21. The sheet on which the toner images are fixed by the fixing device is discharged on a sheet discharge tray (not shown). Incidentally, the toner remaining on the intermediary transfer belt 16 without being transferred onto the recording material P at the secondary transfer portion is collected by the intermediary transfer belt cleaning means 19 for cleaning the intermediary transfer belt 16.

(Electric Charge Adjustment of Untransferred Toner)

In any cases, the major part of the toner (untransferred toner) remaining on the photosensitive drum 11 without being transferred little has a normal polarity of normal toner (negative in this embodiment). For that reason, the polarity of the untransferred toner is predominantly determined by a reversely charged toner component (of a positive charge polarity in this embodiment). That is, the untransferred toner remaining on the photosensitive drum 11 without being transferred after the toner images are transferred onto the intermediary transfer belt 16 by the primary transfer charger 14 is the reversely charged toner in many cases.

Therefore, the auxiliary charger 15 adjusts the electric charge of the untransferred toner by being supplied with a bias from a high voltage source 150 (150*a* to 150*d*) as the bias application means. Specifically, the auxiliary charging brush imparts negative electric charge of an identical polarity to the normal toner charge polarity to the reversely charged toner (untransferred toner). When the reversely charged toner passes through a contact portion between the photosensitive drum 11 and the auxiliary charger 15, the bias of the identical polarity to the normal toner charge polarity is applied to the auxiliary charger 15, so that electric discharge is caused to occur at a certain level or more. As a result, the negative electric charge having the same polarity as that of the normal toner is imparted to the reversely charged toner (untransferred toner) on the photosensitive member. That is, the bias application means 150 applies the DC bias of the identical polarity to the charge polarity of the normal toner to the auxiliary charger 15. Thus, the untransferred toner is charge-adjusted to the normal polarity when it passes through the contact portion between the photosensitive drum 11 and the auxiliary charger 15.

In this embodiment, the voltage of −900 V is applied to the auxiliary charger 15 to impart the electric charge to the reversely charged toner, so that the resultant electric charge amount is −125 μC/mg. However, when the toner electric charge amount is −125 μC/mg, the collection efficiency by the developing device 13 is very poor (FIG. 4(*c*)).

Actually, the toner electric charge amount is changed to −50 μC/mg by the charging roller 12 supplied with the charging bias (DC: −700 V, AC: 1800 Vpp). Thus, the toner electric charge is controlled so that the relationship of: (mirror force (F1))<(developing device collection force (F2)) is satisfied in FIG. 4(*a*). As a result, a high collection efficiency is achieved at the developing portion (FIG. 4(*c*)).

<6> Width (Length) Relationship of Drum Cartridge

Widths of the respective constituent elements associated with the image formation with respect to the photosensitive member rotation shaft direction are determined on the basis of a width ($W_M$) of the image forming area. Specifically, as the image forming area width, in the case where a width corresponding to A4 portrait (210 mm) is ensured, for example, the developing sleeve width is 240 mm, the charging roller width is 270 mm, and the photosensitive layer width of the photosensitive drum is 280 mm. The length (width) relationship among these constituent elements may desirably satisfy: (photosensitive layer width of photosensitive drum) >(charging roller width)>(developing sleeve width)> (image forming area width). The reasons for this will be briefly described below.

Magnetic flux at an end portion of the developing sleeve is lower in uniformity than that at a central portion of the developing sleeve. That is, the toner carried at the developing sleeve end portion is less liable to be uniformly carried compared with the toner carried at the developing sleeve central portion. For that reason, as the image forming area, the developing sleeve central portion at which the toner is uniformly coated is used.

(Reason why Sponge Layer Width is Larger than Developing Sleeve Width)

Charging uniformity at an end portion of the charging roller is lower than that at a central portion of the charging roller. For that reason, the sponge layer width is made larger than the developing sleeve width in order to use the charging roller central portion at which the charging uniformity is high. Further, the photosensitive member is electrically charged by the charging roller, so that the deposition of the toner scattered from the sleeve end portion onto the photosensitive drum can be suppressed.

(Reason why Photosensitive Layer Width of Photosensitive Drum is Larger than Charging Roller Width)

From the viewpoint of manufacturing accuracy, it is difficult to keep a thickness of the photosensitive layer of the photosensitive drum at a constant level throughout its width (length). For that reason, when the photosensitive layer width is made substantially equal to the charging roller width, the photosensitive member leak occurs at a portion at which the photosensitive layer is thin, so that the photosensitive drum cannot be electrically charged. Therefore, at the central portion, the photosensitive drum is electrically charged by the charging roller.

<7> Cartridge Width and Drum Lifetime in Conventional Embodiments

Then, longitudinal direction width relationships of conventional cleaner-less drum cartridges will be described.

(Conventional Embodiment 1)

(Relationship of Effective Widths in Longitudinal Direction)

In Conventional Embodiment 1, the following longitudinal direction width relationship shown in FIG. 2(*a*) is satisfied.

$$W_{PM}>W_{TD}>W_{CD}>W_{ACD}>W_{DD}$$

$W_{PM}$: the photosensitive layer width of the photosensitive drum 11

$W_{TD}$: the sponge layer width of the primary transfer roller 14

$W_{CD}$: the rubber layer width of the charging roller 12

$W_{ACD}$: the fiber-implanted width of the brush of the auxiliary charger 15

$W_{DD}$: the toner coat width of the developing device 13.

Incidentally, the respective members (constituent elements) are disposed on the basis of a (longitudinal) center line perpendicular to the photosensitive member rotation shaft direction.

(Abrasion Amount)

FIG. 2(*b*) shows a graph regarding the abrasion amount of the photosensitive drum in Conventional Embodiment 1. The photosensitive drum is abraded in area (2) with the number of sheets (subjected to continuous image formation) of about 50,000 ($50\times10^3$) sheets, so that the photosensitive member leak occurs. For that reason, the drum cartridge is in an unusable state. This is because the scattered toner deposited in the area (2) is not charge-adjusted by the auxiliary charger, so that the scattered toner is gradually accumulated (deposited) on the photosensitive member (scattered toner accumulation area). For that reason, when the area in which the scattered toner is accumulated contacts the charger, abnormal electric discharge occurs and the abrasion amount is increased in the area (2).

(Cartridge Width)

The cartridge width ($W_{CTG}$) is determined depending on the maximum effective width ($W_{MAX}$) of the auxiliary charger. The width ($W_{CTG}$) of the cartridge including a driving train or the like for performing reciprocal drive in Conventional Embodiment 1 is 320 mm.

(Conventional Embodiment 2)

(Relationship of Effective Widths in Longitudinal Direction)

Figure 3:
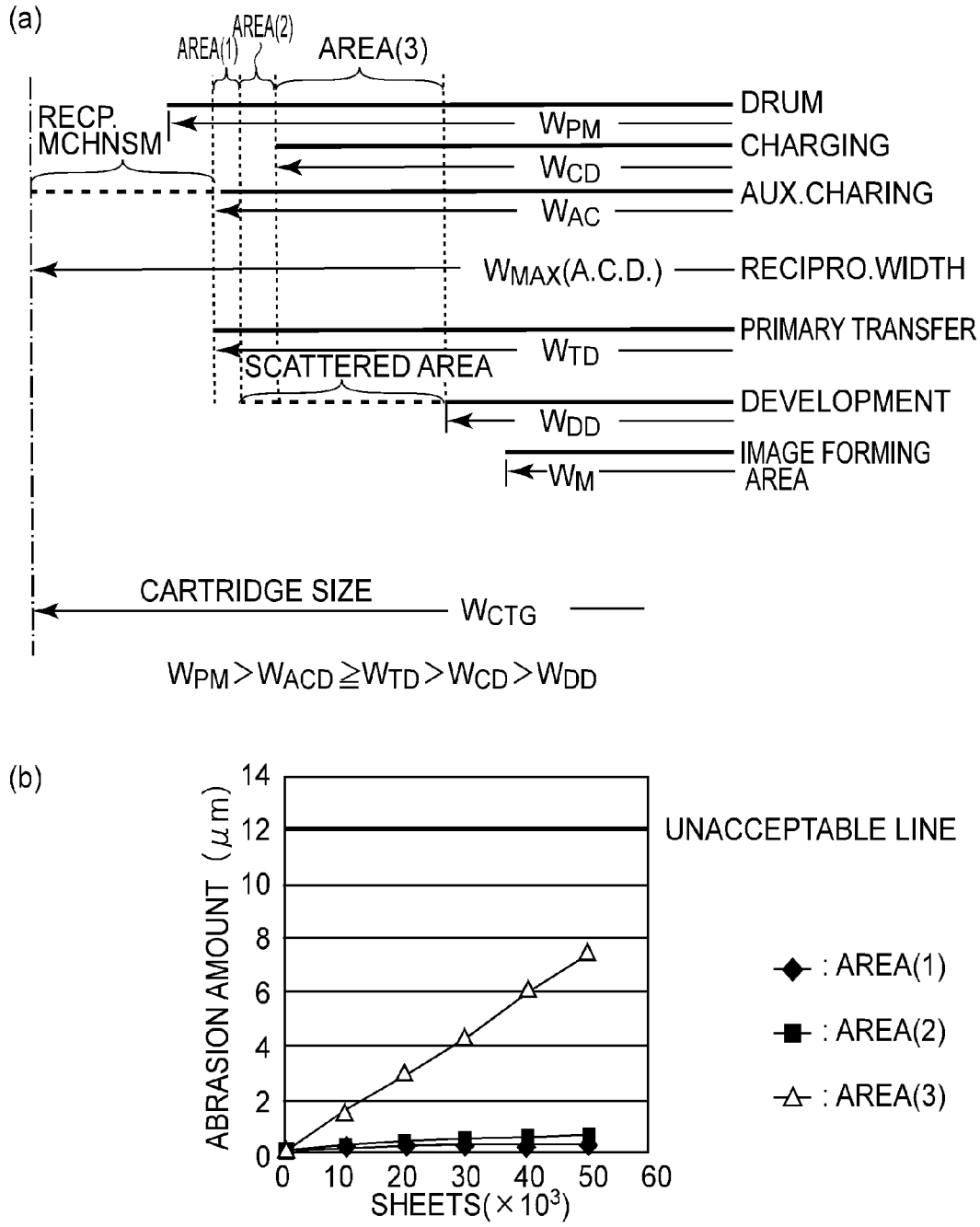
FIGS. 3(*a*) and 3(*b*) are schematic views for illustrating lengths (widths) of the respective image forming elements in their longitudinal directions in another conventional constitution in which the auxiliary charger is longer and for illustrating the photosensitive drum abrasion amount in the constitution, respectively (Conventional Embodiment 2).

In Conventional Embodiment 2, the following longitudinal direction width relationship shown in FIG. 3(*a*) is satisfied.

$$W_{PM}>W_{ACD}\geqq W_{TD}>W_{CD}>W_{DD}$$

(Abrasion Amount)

FIG. 3(*b*) is a graph regarding the abrasion amount of the photosensitive drum in Conventional Embodiment 2. As is clear from the graph, the drum abrasion amount is decreased, so that the drum lifetime is increased. This is because all the areas of the photosensitive drum passing through the charger contact the auxiliary charger and the transfer charger, so that the toner accumulation and excessive electric discharge are less liable to occur.

(Cartridge Width)

The cartridge width ($W_{CTG}$) is determined depending on the maximum effective width ($W_{MAX}$) of the auxiliary charger. The width ($W_{CTG}$) of the cartridge including the driving train or the like for performing the reciprocal drive in Conventional Embodiment 2 is 360 mm. Incidentally, in order to obtain a untransferred toner collecting performance similar to that in Conventional Embodiment 1, in this embodiment, a width in which the auxiliary charging brush is reciprocated is equal to that in Conventional Embodiment 1.

<8> Cartridge Width and Drum Lifetime in this Embodiment

In this embodiment (Embodiment 1), compared with Conventional Embodiments 1 and 2, the width of the auxiliary charger 15 is decreased. Specifically, the relationship of: $W_{PM}>W_{CD}>W_{ACD}\geqq W_{TD}>W_{DD}$ is satisfied, so that in the areas (1) to (3), it was possible to suppress the accumulation of the scattered toner causing the abrasion of the photosensitive drum. Incidentally, a scattered toner generation area causing the abnormal electric discharge is divided into three areas, which are the following areas (1), (2) and (3) in this embodiment.

Area (1): this area is the scattered toner generation area and in this area, the charging roller 12, the auxiliary charger 15 and the primary transfer charger 14 are not present.

Area (2): this area is the scattered toner generation area and in this area, the auxiliary charger 15 and the primary transfer charger 14 are not present.

Area (3): this area is the scattered toner generation area.

(Relationship of Effective Widths in Longitudinal Direction)

Figure 5:
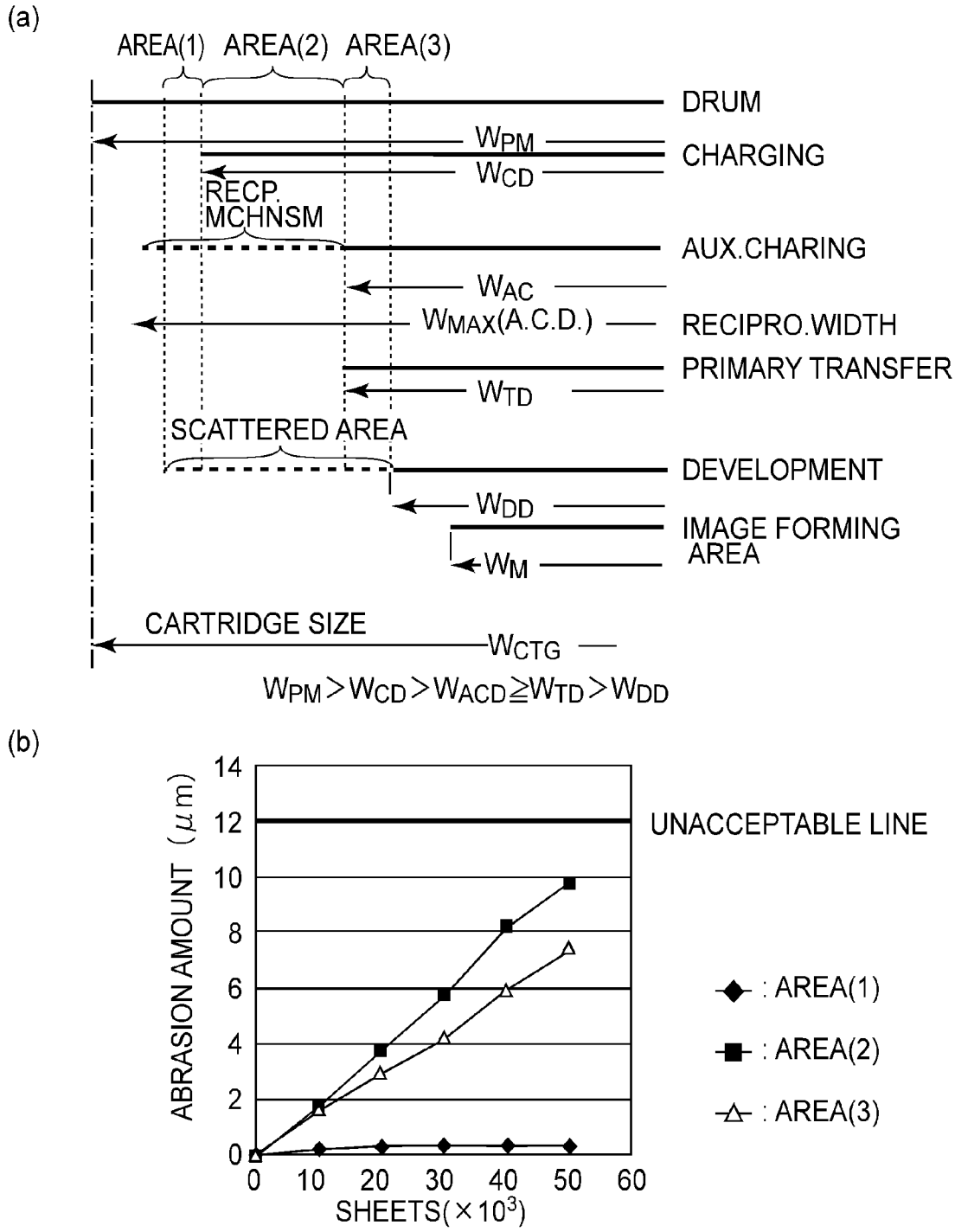
FIGS. 5(*a*) and 5(*b*) are schematic view for illustrating lengths (widths) of the respective image forming elements in their longitudinal directions in a constitution of the present invention and for illustrating the photosensitive drum abrasion amount in the constitution of the present invention, respectively.

The effective widths in the longitudinal direction in this embodiment satisfies the following relationship as shown in FIG. 5(*a*) (showing only the left-side constitution).

$$W_{PM}>W_{CD}>W_{ACD}\geqq W_{TD}>W_{DD}$$

By setting the longitudinal direction widths of the respective constituent elements associated with the image formation so as to satisfy the above relationship, the above-described areas (1), (2) and (3) are provided.

A characteristic portion will be further described. In order to reduce the drum abrasion amount and downsize the cartridge, it is necessary to satisfy the relationship of: $W_{CD}>W_{ACD}\geqq W_{TD}$. First, by satisfying the relationship of: $W_{ACD}\geqq W_{TD}$, the accumulation of the scattered toner on the photosensitive drum can be suppressed. Further, by satisfying the relationship of: $W_{CD}>W_{ACD}$, the cartridge size ($W_{CTG}$) can be made smaller than those in Conventional Embodiments 1 and 2. As described above, the scattered toner accumulation results in the increase in abrasion amount (i.e., the decrease in drum lifetime).

By employing the above-described constitution, the scattered toner on the photosensitive drum is removed from the photosensitive drum by the developing device and the transfer charger. Specifically, the toner, charge-adjusted to the normal polarity by the auxiliary charging device, located at a portion where the photosensitive drum opposes the charging device, is collected in the developing device. Further, the toner, charge-adjusted to the normal polarity by the auxiliary charging device, deposited in an area in which the photosensitive drum does not oppose the developing device but opposes the transfer charger, is transferred onto the intermediary transfer belt by the transfer charger. Here, the scattered toner in the areas (1) and (2) of the photosensitive drum is less liable to have polarized electric charge toward the reversely charged polarity opposite to the normal polarity. For that reason, the scattered toner deposited on the photosensitive drum in the area (2) is adjusted so that its electric charge polarity is the normal polarity, and is distributed over the width ($W_{MAX}$) of the auxiliary charger by the reciprocation of the auxiliary charger. For this reason, the scattered toner in the area (2) is removed from the photosensitive drum by the transfer charger or the developing device. Incidentally, the area (1) does not contact the charging roller, so that even when the scattered toner is present in the area (1), the abnormal electric discharge is not caused to occur. Here, the width of the area (2) ($W_{CD}$ - $W_{ACD}$) is smaller than a width in which the auxiliary charger is moved by the reciprocating mechanism ($W_{MAX}$- $W_{ACD}$). Incidentally, by the increase in accumulation amount of the scattered toner, a total electric discharge amount is increased in many cases even when the scattered toner is not electrically charged by the transfer charger. For that reason, in the constitution of this embodiment, the damage by the electric discharge is alleviated by making the width of the area (2) liable to be affected by the scattered toner larger than the width of the area (3) in which re-charging by the transfer charger occurs. Further, in order to effectively distribute the scattered toner by the reciprocating mechanism, it is preferable that the width of the area (2) is substantially equal to the width of the area (1).

(Abrasion Amount)

FIG. 5(*b*) is a graph regarding the abrasion amount of the photosensitive drum in this embodiment. As is clear from the graph, compared with Conventional Embodiment 1, the drum abrasion amount in the area (2) is decreased, so that the drum lifetime is increased. This is because the electric charge of the scattered toner deposited on the photosensitive drum in the areas (2) and (3) is controlled by making the width (length) of the auxiliary charger equal to that of the transfer charger. Further, the charge-controlled scattered toner is transferred onto the intermediary transfer belt 16 by the transfer charger, so that the abnormal electric discharge caused due to the accumulation of the scattered toner is suppressed. Further, the width of the area (2) is ensured so as to be sufficiently larger than the width of the area (3), so that the abrasion amount of the photosensitive drum in the area (2) is decreased. Details will be described in <9> appearing hereinafter.

(Cartridge Width)

The cartridge width ($W_{CTG}$) is determined depending on the length ($W_{PM}$) of the photosensitive drum. The cartridge width in this embodiment is 300 mm. Incidentally, in order to obtain the untransferred toner collecting performance equal to that in Conventional Embodiment 1, the reciprocation width was made equal to that in Conventional Embodiment 1. Further, in this embodiment, the auxiliary charger 15 is configured to have the width smaller than that of the auxiliary charger shown in FIG. 2(*a*) by about 20 mm. For that reason, the reciprocating driving train was disposed in a cartridge space created by reducing the auxiliary charger width by 20 mm, so that it was possible to reduce the cartridge size ($W_{CTG}$) by 20 mm compared with the constitution of the Conventional Embodiment 1.

<9> Reason why Abrasion Amount is Decreased in this Embodiment

As described above, the photosensitive drum is increased in abrasion amount when the amount of the electric discharge caused between the photosensitive drum and the member contactable thereto. Especially, when the abnormal electric discharge is caused by the accumulation of the scattered toner on the photosensitive drum, the abrasion amount of the photosensitive drum is considerably increased. For that reason, the lifetime of the photosensitive drum is increased by suppressing the abnormal electric discharge. Therefore, in the image forming apparatus in this embodiment, the length (width) relationship among the respective constituent elements associated with the image formation with respect to the photosensitive drum rotation shaft direction (longitudinal direction) are set to satisfy the above-described relationship. As a result, the abnormal electric discharge caused by the scattered toner accumulation was suppressed.

The minimum width ($W_{ACD}$) of the auxiliary charger 15 with respect to the longitudinal direction was determined by a width in which the scattered toner generated from the developing device 13 was charge-controllable, and the scattered toner was primary-transferred onto the intermediary transfer belt 16 by the charge control, so that the scattered toner accumulation onto the photosensitive drum was suppressed.

When the scattered toner is accumulated on the photosensitive drum, the abnormal electric discharge is caused to occur in an electric discharge area in the neighborhood of the nip in which the photosensitive drum 11 and the charging roller 12 contact each other. The drum abrasion amount in the area in which the abnormal electric discharge occurs (e.g., in the area (2) in Conventional Embodiment 1) is larger than that in the image forming area ($W_M$). The abrasion amount of the photosensitive drum is increased in the area in which the scattered toner is accumulated on the photosensitive drum (in the area in which the abnormal electric discharge occurs).

Here, fluctuation in potential in the areas (1) to (3) of the photosensitive drum and the charging (electric discharge) caused by the potential fluctuation will be described.

With respect to the potential in the area (1), the photosensitive drum surface potential continues at about 0 V since the charging means and discharging means (the transfer charger) are not present.

In the area (2), the charging roller 12 is present with respect to the photosensitive drum 11. For that reason, the potential in the area (2) is the charge potential (VD). Thereafter, the potential is gradually changed toward 0 V potential due to self-attenuation capacity. When the photosensitive drum is rotated one full circumference, the surface of the developer is electrically charged again to the charge potential (VD) by the charging roller 12. For that reason, when the self-attenuation amount of the photosensitive drum is small, the electric discharge amount by the re-charging by the charging roller 12 is decreased. In other words, until the electric charge is removed by the self-attenuation capability of the photosensitive drum 11, the electric discharge does not occur in the electric discharge area in the neighborhood of the nip in which the photosensitive drum 11 and the charging roller 12 contact each other.

In the area (3), the charging roller 12, the auxiliary charger 15, and the transfer charger 14 are present with respect to the photosensitive drum 11. The photosensitive member (photosensitive drum) is electrically charged to the charge potential (VD) by the charging roller. Thereafter, the photosensitive drum surface potential is once lowered by the transfer charger. Thereafter, the photosensitive drum is (negatively) charged again by the auxiliary charger 15. The photosensitive drum is thus electrically charged again by the auxiliary charger, so that the amount of the electric discharge by the re-charging by the charging roller is relatively decreased.

Here, the scattered toner in the area (2) is only distributed by the reciprocating mechanism, so that a scattered toner removing performance is not high. However, as described above, the amount of the electric discharge by the re-charging in the area (2) is small, so that the abrasion amount of the photosensitive drum can be suppressed. Further, in the area (3), the scattered toner is charge-adjusted to the normal polarity by the auxiliary charger and is transferred onto the intermediary transfer belt by the transfer charger. For that reason, in the area (3), the abnormal electric discharge due to the accumulation of the scattered toner does not occur. However, the portion charged by the charger is discharged by the transfer charger and then is charged again by the auxiliary charger, so that the electric discharge amount is relatively increased. Here, in order to suppress the abrasion amount of the photosensitive drum, there are a method of suppressing the scattered toner accumulation and a method of suppressing the re-charging. By using any one of these methods, the lifetime of the photosensitive drum can be sufficiently increased.

According to this embodiment, the scattered toner accumulation can be suppressed in the areas (1) to (3). For that reason, the abnormal electric discharge resulting from the scattered toner accumulation is suppressed, so that the abrasion amount of the photosensitive drum in the continuous image formation is decreased. As a result, the increased lifetime of the photosensitive drum and the downsizing of the drum cartridge which have not been conventionally achieved can be achieved. Specifically, as is understood from the changes in abrasion amount in the areas (1) to (3) shown in FIG. 5(*b*), in this embodiment, compared with Conventional Embodiment 1 (FIG. 2(*a*)), the abrasion amount of the photosensitive drum is considerably reduced.

The abrasion amount of the photosensitive drum can be reduced by suppressing the amount of the electric discharge with respect to the photosensitive drum and/or suppressing the scattered toner accumulation. In this embodiment, in the area (2), the total amount of the electric discharge with respect to the photosensitive drum is decreased by disposing the photosensitive drum so as not to oppose the transfer charger in the area (2). Further, in the area (3), the scattered toner charge-adjusted to the normal polarity by the auxiliary charger is transferred onto the intermediary transfer belt by the transfer charger, so that the scattered toner accumulation is prevented. That is, by constituting the cartridge so as to satisfy the relationship of: $W_{CD}>W_{ACD}$ it is possible to eliminate the area in which the amount of the electric discharge with respect to the photosensitive drum is large and the scattered toner is accumulated, such as the area (2) in Conventional Embodiment 1. Further, by constituting the cartridge so as to satisfy the relationship of: $W_{PM}>W_{MAX}>W_{CD}>W_{ACD}$, the scattered toner in the area (2) is distributed over the width ($W_{MAX}$ or $W_{RM}$) in which the auxiliary charger is moved. For that reason, the scattered toner in the area (2) is distributed over $W_{MAX}$ and is charge-adjusted to the normal polarity by the auxiliary charger to be collected in the developing device or is transferred onto the intermediary transfer belt by the transfer charger. In this embodiment, the width of the area (2) ($W_{CD}-W_{ACD}$) is larger than the width in which the auxiliary charger is moved by the reciprocating mechanism ($W_{MAX}-W_{ACD}$). As a result, the toner in the area (2) is decreased by being distributed into the area (1) and the area (3) which are adjacent to the area (2).

As described above, by setting the longitudinal direction width relationship among the respective constituent elements associated with the image formation so as to satisfy the above-described relationship in this embodiment, even in the case where the scattered toner is generated by the continuous image formation, the electric discharge by the charging roller 12 and the auxiliary charger 15 can be considerably reduced. As a result, the amount of the abrasion of the photosensitive drum 11 due to the abnormal electric discharge can be considerably decreased, so that the lifetime of the drum cartridge can be increased.

(Effective Width)

As described above, the photosensitive drum abrasion amount is associated with the potential of the surface of the photosensitive drum changed depending on the respective constituent elements associated with the image formation. The measurement of the effective widths described above may also be performed in the following manner. For example, the photosensitive drum is electrically charged by using the charging roller to which the charging bias is applied, and a width in which the photosensitive drum is charged to the charge potential may also be taken as the effective width. The width in which the photosensitive drum is charged to the charge potential is measured by using a potential sensor used for measuring the photosensitive drum potential. Similarly, the surface potential of the photosensitive drum is changed by the transfer charger to which the transfer bias is applied. For that reason, the width in the area in which the photosensitive drum potential is changed by the transfer charger may also be taken as the effective width.

(Embodiment 2)

The image forming apparatus in this embodiment has the substantially same constitution as that of the image forming apparatus described in Embodiment 1. For that reason, the same portions (devices) are represented by the same reference numerals or symbols, thus being omitted from description. Incidentally, the relationship among the effective widths of the respective constitutional elements associated with the image formation in this embodiment is identical to that in Embodiment 1.

In Embodiment 1, the charging bias applied to the charging roller was in the form of the DC bias superposed with the AC bias. On the other hand, in this embodiment, the bias applied to the charging roller 12 is only the DC bias.

Figure 6:
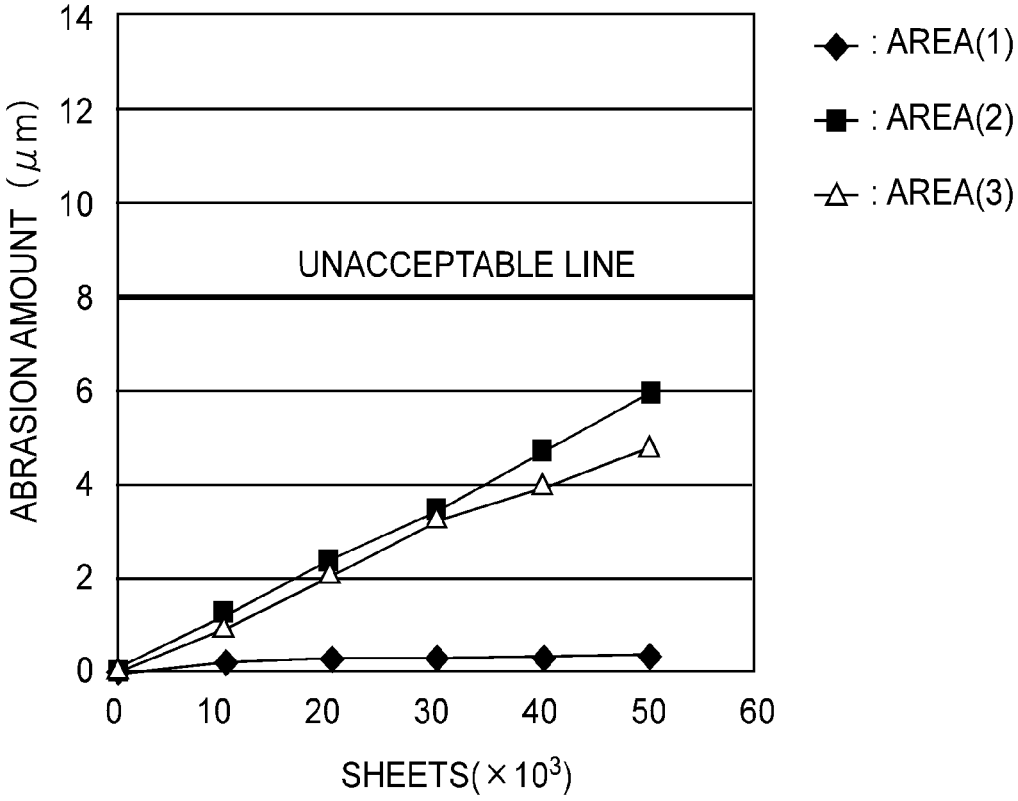
FIG. 6 is a graph for illustrating the photosensitive drum abrasion amount in the case where a DC bias is applied to a charging roller in another constitution of the present invention.

By using only the DC voltage (bias), the abrasion amount of the photosensitive drum 11 can be considerably reduced compared with the case of Embodiment 1. In this constitution, an initial thickness of the photosensitive drum 11 is decreased and at the same time cost reduction is realized by eliminating the AC voltage source. FIG. 6 is a graph showing a durability test result in the case where only the DC bias is applied to the charging roller. As is clear from FIG. 6, the abrasion amounts in the area (2) and the area (3) are considerably decreased compared with those in Embodiment 1. That is, by not applying the AC bias to the charging roller, the lifetime of the photosensitive drum can be further increased. Incidentally, with respect to the cartridge size, the cartridge size can be reduced similarly as in Embodiment 1, so that the image forming apparatus can be downsized.

(Other Embodiments)

In Embodiment 1, the image forming apparatus using the intermediary transfer method in which the toner image to be transferred onto the sheet is transferred onto the intermediary transfer belt and using the fixed brush as the auxiliary charging device was described. However, the present invention is not limited to the image forming apparatus having such a constitution.

(a) Constitution Using Fur Brush as Auxiliary Charger

Figure 7:
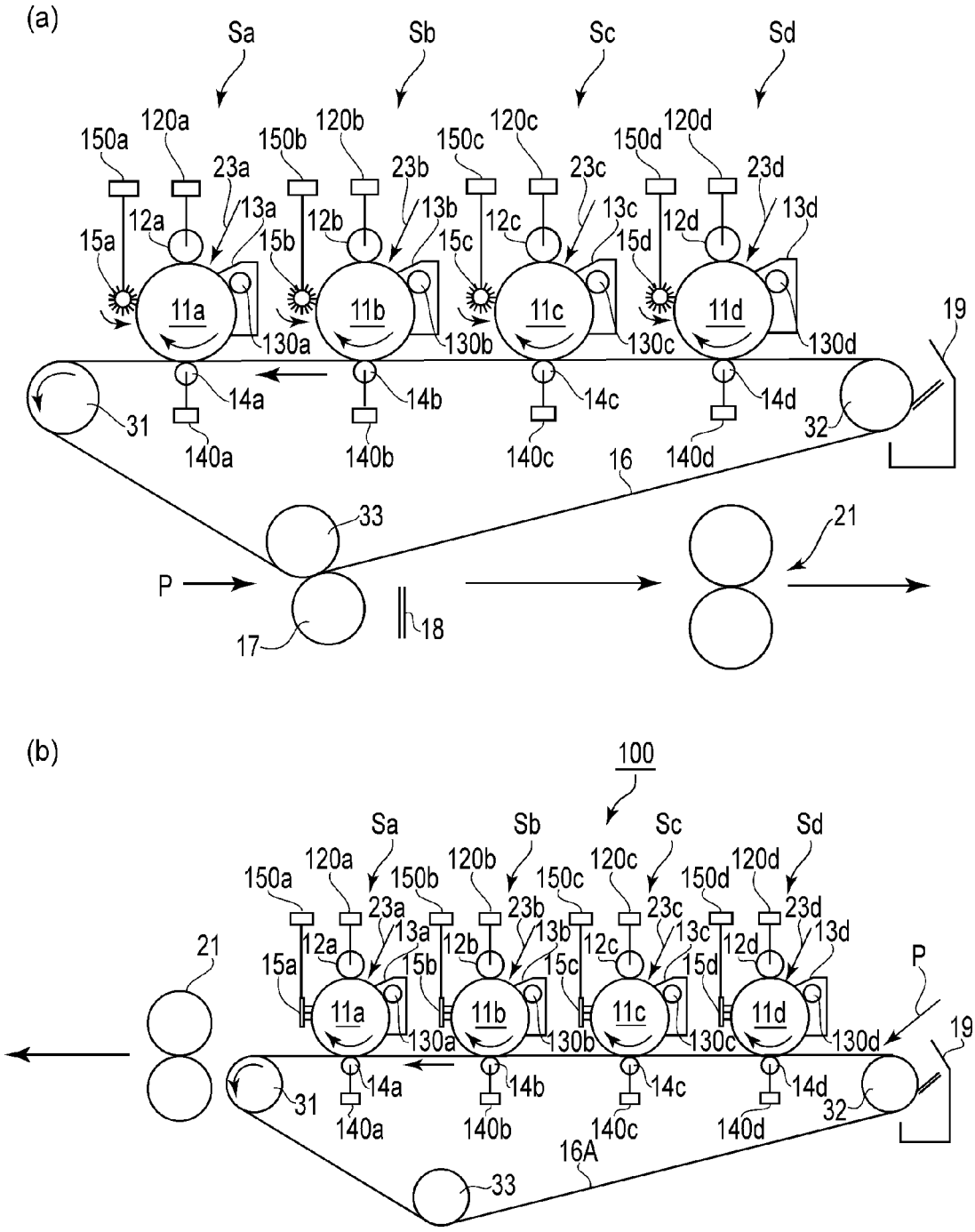
FIGS. 7(*a*) and 7(*b*) are schematic structural views showing another embodiment of the image forming apparatus according to the present invention.

In Embodiment 1, the fixed brush was used but a rotatable fur brush may also be used. FIG. 7(*a*) is a schematic view for illustrating a schematic structure of an image forming apparatus using the fur brush as the auxiliary charger. The effective width relationship among the respective constituent elements associated with the image formation is identical to that in Embodiment 1.

The rotatable fur brush as the auxiliary charger 15 is rotatably driven in the same direction as the rotational direction of the photosensitive drum 11 at the contact portion thereof with the photosensitive drum 11. At the contact portion, the fur brush may also be rotationally driven in the opposite direction to the rotational direction of the photosensitive drum 11. The fur brush includes a metal shaft and electroconductive rayon fibers implanted into the metal shaft. The fibers have a fineness of 6 denier, a pile length of 5 mm, and a fiber (filament) density of 100 KF. Similarly as in Embodiment 1, the fiber-implanted width is referred to as the auxiliary charging effective width. The fibers may also be nylon fibers and polyester fibers may also be used. These fibers may desirably have the fineness of 2 to 10 denier, the pile length of 3 to 8 mm, and the fiber density of 50 to 500 KV.

The advantages that the fur brush is used as the auxiliary charger 15 are that the untransferred toner can be stably charge-controlled throughout the continuous image formation irrespective of properties of the toner used, such as a particle size and a degree of agglomeration and that the rubbing force for rubbing the surface of the photosensitive drum 11 can be optimized depending on hardness of the photosensitive drum 11 and the auxiliary charger 15. In the constitution using such a fur brush, compared with the case of using the fixed brush as the auxiliary charger, it is possible to efficiently remove a melted product generated on the photosensitive drum surface during the continuous image formation.

(b) Constitution Using Direct Transfer Method

In Embodiment 1, the color image forming apparatus using the intermediary transfer method is described but the present invention is not limited thereto. For example, the image forming apparatus of the present invention may also be an image forming apparatus using a direct transfer method as shown in FIG. 7(*b*). In the direct transfer method, onto the recording material P (sheet) as the image receiving member conveyed to each of the image forming portions by the recording material carrying member, the toner images formed on the respective photosensitive drum 11 surfaces are successively transferred directly. In the direct transfer method, the respective cartridges (Sa, Sb, Sc, Sd) are disposed along a conveyer belt 16A as the recording material carrying member for conveying the recording material. Further, the conveyer belt 16A is stretched around the supporting rollers 31, 32 and 33 and is rotationally movable in the direction indicated by the arrow.

In addition to the above constitutions, a similar functional effect can also be obtained even when the present invention is applied to a monochromatic image forming apparatus.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 296134/2008 filed Nov. 19, 2008 and 253073/2009 Filed Nov. 4, 2009, which are hereby incorporated by reference.

What is claimed is:

1. An image forming apparatus comprising:

a rotatable photosensitive member;

a charging device for electrically charging said photosensitive member with electric discharge by being supplied with a voltage;

a developing device for developing with toner an electrostatic image formed on said photosensitive member electrically charged by said charging device;

a transfer device for transferring a toner image from said photosensitive member onto an image-receiving member, wherein a voltage of an opposite polarity to that of the voltage supplied to said charging device is applied to said transfer device; and an auxiliary charging device for electrically charging untransferred toner on said photosensitive member to a normal charge polarity before said photosensitive member is electrically charged by said charging device, wherein effective widths $W_{PM}$, $W_{CD}$, $W_{DD}$, $W_{TD}$, and $W_{ACD}$ of said photosensitive member, said charging device, said developing device, said transfer device, and said auxiliary charging device, respectively, satisfy:

$$W_{PM}>W_{CD}>W_{ACD}\geqq W_{TD}>W_{DD}.$$

2. An apparatus according to claim 1, further comprising a reciprocally moving device for reciprocally moving said auxiliary charging device in a rotation shaft direction of said photosensitive member, wherein a width $W_{MAX}$ in which said auxiliary charging device is moved by said reciprocally moving device, and the effective widths $W_{PM}$, $W_{CD}$, and $W_{ACD}$ satisfy:

$$W_{PM}>W_{MAX}>W_{CD}>W_{ACD}.$$

3. An apparatus according to claim 2, wherein the widths $W_{CD}$, $W_{ACD}$, $W_{TD}$, and $W_{DD}$ satisfy:

$$(W_{CD}-W_{ACD})>(W_{TD}-W_{DD}).$$

4. An apparatus according to claim 1, wherein said auxiliary charging device is supplied with a voltage of the same polarity as that of the voltage supplied to said charging device, and wherein at a region inside the effective width $W_{CD}$ of said charging device and outside the effective width $W_{ACD}$ of said auxiliary charging device is prevented from contacting said transfer device to which the voltage of the opposite polarity to that of the voltage supplied to said charging device is applied.

* * * * *